US009604820B2

(12) United States Patent
De Jong

(10) Patent No.: US 9,604,820 B2
(45) Date of Patent: Mar. 28, 2017

(54) METHOD AND ELEVATOR ARRANGEMENT

(71) Applicant: KONE CORPORATION, Helsinki (FI)

(72) Inventor: Johannes De Jong, Järvenpää (FI)

(73) Assignee: KONE CORPORATION, Helsinki (FI)

( * ) Notice: Subject to any disclaimer, the term of this patent is extended or adjusted under 35 U.S.C. 154(b) by 662 days.

(21) Appl. No.: 13/930,724

(22) Filed: Jun. 28, 2013

(65) Prior Publication Data

US 2013/0284543 A1 Oct. 31, 2013

Related U.S. Application Data

(63) Continuation of application No. PCT/FI2011/000054, filed on Dec. 21, 2011.

(30) Foreign Application Priority Data

Dec. 31, 2010 (FI) ..... 20106401

(51) Int. Cl.
*B66B 11/00* (2006.01)
*B66B 19/00* (2006.01)
*B66B 11/08* (2006.01)

(52) U.S. Cl.
CPC ..... *B66B 11/00* (2013.01); *B66B 19/002* (2013.01)

(58) Field of Classification Search
CPC ..... B66B 11/00; B66B 19/00; B66B 19/002; B66B 19/04

(Continued)

(56) References Cited

U.S. PATENT DOCUMENTS 5,033,586 A * 7/1991 Richards ..... B66B 9/187 187/259
5,655,628 A * 8/1997 Lin ..... B66B 13/245 182/84
8,469,155 B2 * 6/2013 Thomsen ..... B66B 13/285 187/394

FOREIGN PATENT DOCUMENTS

FI WO 2011080387 A1 * 7/2011 ..... B66B 19/00
FI WO 2011148032 A1 * 12/2011 ..... B66B 19/005

(Continued)

OTHER PUBLICATIONS

AIPN, Machine Translation, JP 08 133 636 A, May 28, 2016, pp. 1-5.*

*Primary Examiner* — William A Rivera
*Assistant Examiner* — Stefan Kruer
(74) *Attorney, Agent, or Firm* — Birch, Stewart, Kolasch & Birch, LLP

(57) ABSTRACT

Method and arrangement in the manufacture of an elevator, which includes during construction time an elevator hoistway, an elevator car, hoisting roping, a supporting structure including a plurality of support elements movable between a position extended from the supporting structure towards the side and a position retracted towards the supporting structure, and a platform. A plurality of lifts are performed, in each of which lifts the supporting structure is lifted higher up in the elevator hoistway, while the support elements are in the retracted position, after which the support elements are displaced into the extended position and the supporting structure is lowered to rest on top of the structures of the building supported by the support elements in the extended position for the vertical support of the supporting structure in the elevator hoistway, and between lifts the elevator car is used for transporting passengers and/or freight between floors.

19 Claims, 3 Drawing Sheets

Figure 1:
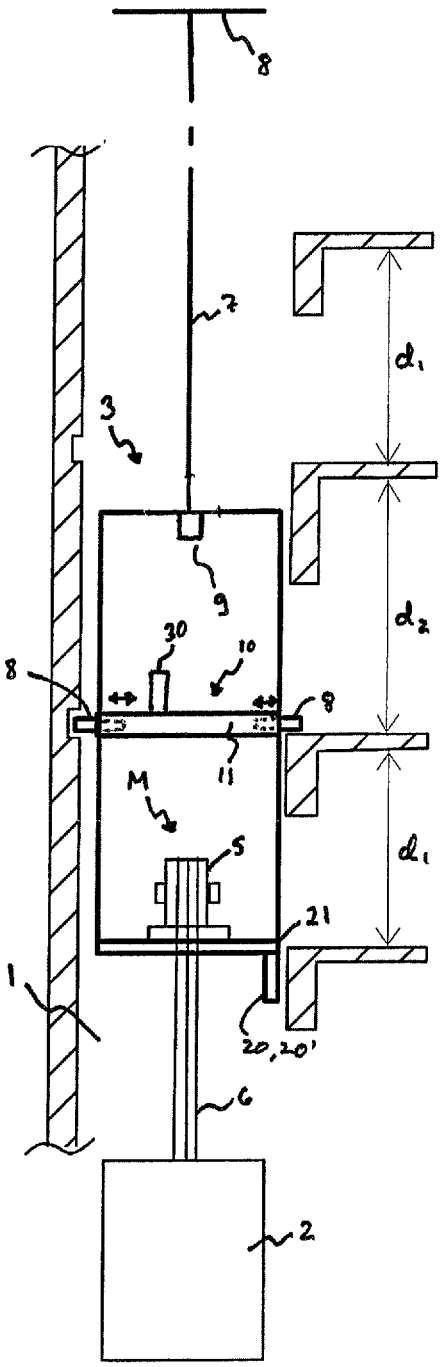

(58) Field of Classification Search
USPC ..... 187/266, 414, 900
See application file for complete search history.

(56) References Cited

FOREIGN PATENT DOCUMENTS

| | | | | | |
|---|---|---|---|---|---|
| FR | 2694279 | A1 * | 2/1994 | ..... | B66B 9/187 |
| JP | 8-53277 | A | 2/1996 | | |
| JP | 08133636 | A * | 5/1996 | ..... | B66B 9/187 |
| JP | WO 2005007550 | A1 * | 1/2005 | ..... | B66B 7/00 |
| JP | 2007-230663 | A | 9/2007 | | |
| WO | WO 00/50328 | A2 | 8/2000 | | |
| WO | WO 2006/010782 | A2 | 2/2006 | | |
| WO | WO 2010/100319 | A1 | 9/2010 | | |

* cited by examiner

METHOD AND ELEVATOR ARRANGEMENT

CROSS-REFERENCE TO RELATED APPLICATIONS

This application is a Continuation of PCT International Application No. PCT/FI2011/000054 filed on Dec. 21, 2011, which claims priority under 35 U.S.C. §119(a) to a Patent Application No. 20106401 filed in Finland on Dec. 31, 2010, all of which are hereby expressly incorporated by reference into the present application.

FIELD OF THE INVENTION

The object of the invention is a method in the manufacture of an elevator and a construction-time elevator arrangement, which elevator is preferably an elevator applicable to passenger transport and/or to freight transport and is to be installed in a building. With the method and with the elevator arrangement, an elevator can be taken into service use already during its construction time.

BACKGROUND OF THE INVENTION

In connection with so-called jump-lifts, the elevator hoistway is taken into use already before the full length of the elevator hoistway has been completed. The top part of the elevator hoistway is constructed at the same time as an elevator car moving in the already completed bottom part of the elevator hoistway serves on the lower floors of the building. The elevator car moving in the bottom part of the elevator hoistway is supported and moved during the construction-time use suspended on hoisting ropes that are supported by a supporting structure in the elevator hoistway, which ropes are moved with a hoisting machine, which can be supported e.g. on a platform comprised in the aforementioned supporting structure. The installation work in the parts of the elevator hoistway above this supporting platform is done from a movable platform or corresponding. When the part of the elevator hoistway under construction above the supporting platform has reached a sufficient stage of completion, the completed part of the elevator hoistway can be taken into use. In this case a jump-lift is performed, wherein the supporting platform is lifted to a higher position in the elevator hoistway, thus extending the operating area of the elevator car upwards. A worksite crane in use in the construction of the building or a lighter lifting device to be supported on the building and arranged for the site for the purpose of the elevator installation can, for example, be used for the lifting. When the elevator hoistway has reached its final height, the jump-lift is converted into the final elevator of the building. In prior art the supporting platform is supported for the period of time between jump-lifts e.g. on the wall structures of the elevator hoistway while resting on support elements comprised in the frame of the supporting platform, each of which elements can be moved in the lateral direction from the supporting platform into an extended position and back towards the platform into a retracted position, supported on which support elements in their extended position the frame of the supporting platform can be lowered to rest on top of the wall structures of the elevator hoistway, for the vertical support of the supporting platform in the elevator hoistway, and when in the retracted position of which support elements the supporting platform can be displaced in the vertical direction in the elevator hoistway without being obstructed by the support elements. This type of support elements is used inter alfa in the solution presented by publication WO2010100319A1.

The supporting structure is generally such that it comprises a platform suited for working or a plurality of such platforms one above the other. For example, a lower platform can have elevator components, such as the machine and/or diverting pulleys, in the proximity of which it must be possible to work safely while standing on the platform. Likewise, a lower platform can have components, in the proximity of which it must be possible to work safely while standing on the platform. A higher platform can have e.g. hoisting means, such as e.g. a hoist, intended for lifting the supporting structure itself. The support means are conventionally disposed at the level of the lower working platform, through which platform the ropes also pass. The support means are disposed in certain points depending on the reeving, which must pass through the platform. Since reevings are at least to some extent different in different installation sites, it has often been necessary to plan an own type of support element placement for each installation site. A problem has also been that the placement of the support points of the building might have become difficult.

A building is generally formed to comprise a plurality of floor landings, onto which is an access opening from the elevator hoistway. There might be a need to form the floor-to-floor heights of the floor landings of the same building to differ from each other. Likewise, the floor-to-floor heights of different buildings differ from each other. Owing to these differences, the size of a supporting structure comprising work platforms one above the other has caused at the point of some floors a situation in which the work platform is well above the floor landing, which could cause a dangerous situation, particularly in an evacuation situation when an exit from the working platform must be made quickly. Namely, rapid transfer away from the work platform is generally possible only by passing through the opening of the floor landing.

AIM OF THE INVENTION

The object of the invention is to eliminate, among others, the aforementioned drawbacks of prior-art solutions. More particularly the aim of the invention is to produce in the manufacture of an elevator a construction-time elevator arrangement and method that are better than before in terms of their design freedom. Furthermore, with the invention one or more of the following advantages, among others, are achieved:

- The lateral placement, shape and size of the support elements can be selected more freely than before.
- A durable support point on the building can be selected more freely than before without layout problems irrespective of the route of the hoisting roping.
- A similar supporting platform can be used in buildings having different floor-to-floor heights.
- A supporting platform that is shallower than before can be used.
- The position of the supporting platform in the vertical direction can be selected more freely than before.
- A safe construction-time elevator arrangement and method are achieved.

SUMMARY OF THE INVENTION

The invention is based on the concept that a rope pulley intended to support an elevator car via roping is disposed essentially lower in a supporting structure than support elements via which the supporting structure is supported during the time between lifts in the elevator hoistway. In this way, generally speaking, additional freedoms are obtained in the layout and more particularly in the placement of support. Likewise, the other aforementioned advantages can be achieved.

In one basic embodiment of the concept according to the invention in the method in the manufacture of an elevator, which elevator comprises during the construction time an elevator hoistway; an elevator car; hoisting roping for supporting and moving the elevator car during use of the elevator car; a supporting structure movable in the vertical direction for supporting the elevator car below it in the elevator hoistway, which supporting structure comprises a plurality of support elements movable between a position extended from the supporting structure towards the side and a position retracted towards the supporting structure; and a platform, which supports a rope pulley, supported by which the hoisting roping is arranged to hang; a plurality of lifts are performed, in each of which lifts the movable supporting structure is lifted higher up in the elevator hoistway, while the support elements are in the retracted position, after which the support elements are displaced into the extended position and the frame of the supporting platform is lowered to rest on top of the structures of the building supported by the support elements in the extended position for the vertical support of the supporting platform in the elevator hoistway, in which method and between lifts the elevator car is used for transporting passengers and/or freight between floors. The aforementioned support elements are essentially above the aforementioned rope pulley. In this way said advantages are achieved.

In a more refined embodiment of the concept according to the invention the elevator hoistway comprises on one of its sides a plurality of openings leading onto floor landings, and the supporting structure comprises an apron that extends downwards, or that can be displaced to extend downwards, from the edge of the platform on the side of the openings leading to a floor landing for covering the gap between the edge of the platform and the sill of the floor landing. In this way said advantages are obtained. For example, the dependency on the height of a floor landing can be reduced.

In a more refined embodiment of the concept according to the invention in the method a lift is performed, after which the supporting structure is supported in the elevator hoistway such that its platform is at the point of the opening of a floor landing essentially above the floor landing, in which case the aforementioned apron essentially covers, or is arranged to essentially cover, the gap between the edge of the working platform and the sill of the floor landing. Thus the arrangement is safe.

In a more refined embodiment of the concept according to the invention the supporting structure comprises a second platform above the aforementioned platform, and that in the method a lift is performed, after which the supporting structure is supported in the elevator hoistway such that a second platform is essentially at the height of a floor landing. Thus it is easily accessible.

In a more refined embodiment of the concept according to the invention the platform is climbed up to from a floor landing along steps and/or the working platform is climbed down from to a floor landing along steps, which are preferably rigidly fixed to the supporting structure. In this way the safety of passage can be increased.

In a more refined embodiment of the concept according to the invention in the method a lift is performed, after which the supporting structure is supported in the elevator hoistway such that its support elements are at least essentially at the height of a floor landing. In this way the use of them can be easily controlled.

In a more refined embodiment of the concept according to the invention in the method a lift is performed, after which the supporting structure is supported in the elevator hoistway such that the support elements of said supporting structure rest on the top surface of the edge of a floor landing and on the top surface of a supporting structure on the opposite side of the elevator hoistway, such as on the top surface of a pocket arranged in the wall of the elevator hoistway. In this way a floor landing can be used as a support point.

In one basic embodiment of the concept according to the invention during construction of the elevator the elevator arrangement comprises an elevator hoistway; an elevator car; hoisting roping for supporting and moving the elevator car during use of the elevator car; a supporting structure movable in the vertical direction for supporting the elevator car below it in the elevator hoistway via roping, which supporting structure comprises a plurality of support elements movably supported on the supporting structure and movable between a position extended from the supporting structure towards the side and a position retracted towards the supporting structure, supported by which support elements in the extended position the supporting structure can be lowered to rest on top of the structures of the building, preferably wall structures of the elevator hoistway, for the vertical support of the supporting structure in the elevator hoistway, and when in the retracted position of which support elements the supporting structure can be displaced in the vertical direction in the elevator hoistway without being obstructed by the support elements; and a platform, which supports a rope pulley, supported by which the hoisting roping is arranged to hang. The aforementioned support elements are essentially above the aforementioned rope pulley. In this way said advantages are achieved.

In a more refined embodiment of the concept according to the invention in the elevator arrangement or in the method the aforementioned rope pulley is the traction sheave of a hoisting machine. Thus the aforementioned platform becomes a machine platform. One advantage is that the machine platform has more space for working than before, which improves safety.

In a more refined embodiment of the concept according to the invention in the elevator arrangement or in the method the supporting structure comprises a second platform above the aforementioned rope pulley, in connection with which second platform the aforementioned support elements are.

In a more refined embodiment of the concept according to the invention in the elevator arrangement or in the method the aforementioned platform and/or the second platform is a platform suited for working on top of it, which comprises a flat standing surface.

In a more refined embodiment of the concept according to the invention in the elevator arrangement or in the method the support elements can be telescopically displaced with the frame of the supporting structure between a retracted and an extended position.

In a more refined embodiment of the concept according to the invention in the elevator arrangement or in the method the aforementioned second platform has a control unit of the hoisting machine and/or of the hoist 9 of the supporting structure. In this way the working space on the platforms can be increased, and safety can be improved.

In a more refined embodiment of the concept according to the invention in the elevator arrangement or in the method the support elements can be displaced in the horizontal direction between a retracted and an extended position.

In a more refined embodiment of the concept according to the invention in the elevator arrangement or in the method the aforementioned plurality of support elements comprises support elements that can be displaced in opposite lateral directions into an extended position.

In a more refined embodiment of the concept according to the invention in the elevator arrangement or in the method the support elements are supported on the frame part of the supporting structure, said frame part being above the aforementioned rope pulley, which frame part is preferably a beam structure, which at least partly forms the aforementioned second platform.

In a more refined embodiment of the concept according to the invention in the elevator arrangement or in the method the elevator hoistway comprises on one of its sides a plurality of openings leading onto floor landings, and the supporting structure comprises an apron that extends downwards, or that can be displaced to extend downwards, from the edge of the platform on the side of the openings leading to a floor landing for covering the gap between the edge of the platform and the sill of the floor landing.

In a more refined embodiment of the concept according to the invention in the elevator arrangement or in the method the aforementioned apron is a flat protrusion extending downwards from the edge or it can be displaced to become a flat protrusion extending downwards from the edge In a more refined embodiment of the concept according to the invention in the elevator arrangement or in the method the aforementioned apron comprises one or more curtains, grilles, plates or nets for covering the gap between the edge of the working platform and the sill of the floor landing.

In a more refined embodiment of the concept according to the invention in the elevator arrangement or in the method the arrangement comprises steps for ascending from a floor landing to a platform/for descending from a platform to a floor landing.

In a more refined embodiment of the concept according to the invention in the elevator arrangement or in the method the aforementioned steps are in the form of a ladder.

In a more refined embodiment of the concept according to the invention in the elevator arrangement or in the method the apron is essentially the width of the landing opening or even wider.

In a more refined embodiment of the concept according to the invention in the elevator arrangement or in the method the apron can be displaced from a retracted state into an extended state, in which extended state the apron extends essentially lower than in the retracted state.

In a more refined embodiment of the concept according to the invention in the elevator arrangement or in the method the supporting structure is supported in its position such that the supporting elements are essentially at the height of a floor landing.

In a more refined embodiment of the concept according to the invention in the elevator arrangement or in the method the building comprises floor-to-floor distances essentially differing from each other between two consecutive floor landings.

In a more refined embodiment of the concept according to the invention in the elevator arrangement or in the method the building comprises consecutive floors, the floor-to-floor distance between which is essentially greater than the distance between the support means of the supporting structure and the edge of the working platform.

In a more refined embodiment of the concept according to the invention in the elevator arrangement or in the method the supporting structure is supported in the elevator hoistway such that its working level is at the point of the opening of a floor landing essentially above the floor landing, and that the arrangement comprises the aforementioned apron, which covers, or can be arranged at least essentially to cover, the gap between the edge of the supporting structure and the sill of the floor landing.

In a more refined embodiment of the concept according to the invention in the method the supporting structure is lifted higher up in the elevator hoistway with means for lifting the supporting structure, which means comprise a lifting device, which is e.g. an electrically driven lifting device, which pulls the supporting structure upwards in the elevator hoistway while resting on a separate support structure to the supporting structure, which support structure is preferably supported in its position in the elevator hoistway above the supporting structure at a distance from the supporting structure, and which lifting device is preferably accessible from the aforementioned second platform (10).

In a more refined embodiment of the concept according to the invention in the method the lifting device 9 is handled from the aforementioned second platform.

Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the framework of the basic inventive concept in conjunction with other embodiments. The additional features or procedures of each embodiment can also singly and separately from the other embodiments form a separate invention.

LIST OF FIGURES

In the following, the invention will be described in detail by the aid of some embodiments with reference to the attached drawings, wherein FIG. 1 presents an arrangement in a phase of the method according to the invention, in which phase the elevator car is in use.

Figure 2:
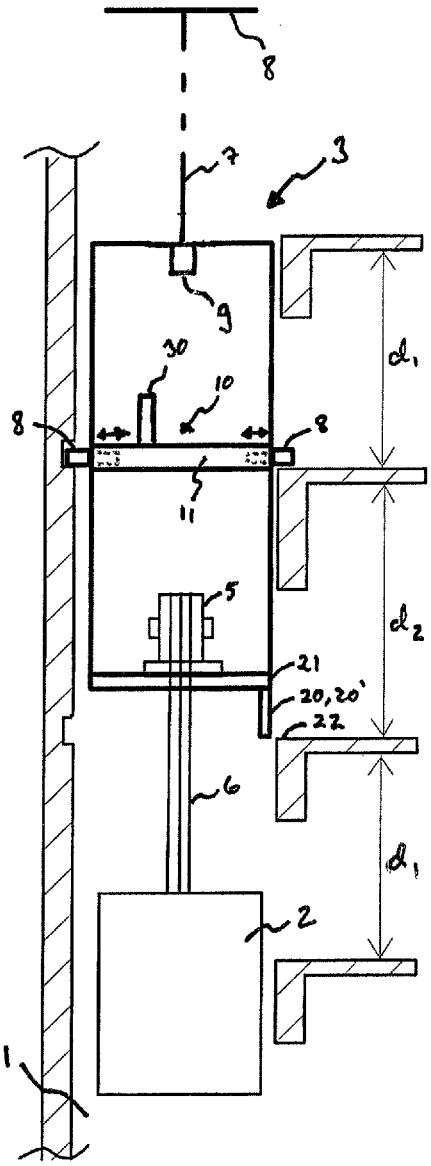

FIG. 2 presents an arrangement in a phase of the method according to the invention, in which phase a lift has been performed.

Figure 3:
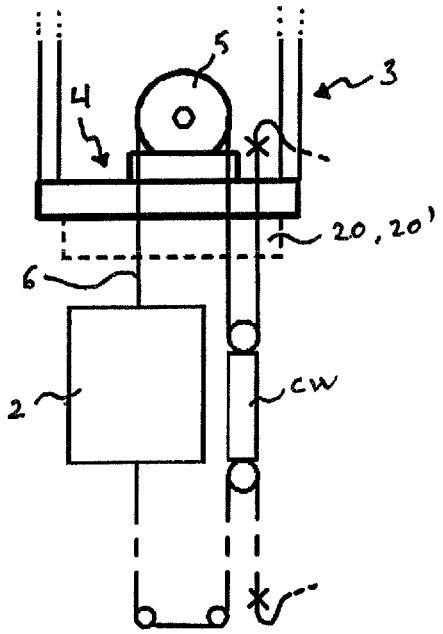

FIG. 3 presents one preferred suspension.

Figure 4:
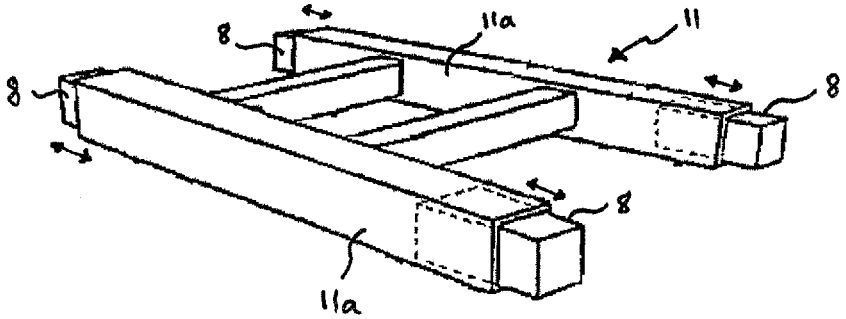

FIG. 4 presents one preferred structure for the frame part of the frame of the supporting structure.

Figure 5:
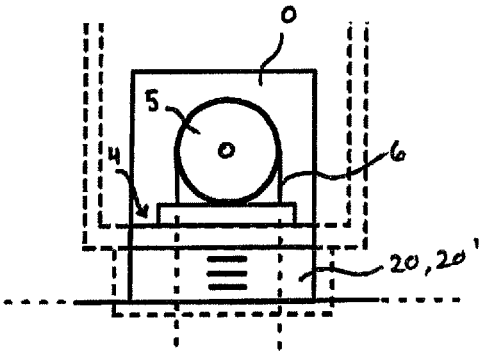

FIG. 5 presents the arrangement of FIG. 2 as viewed from a floor landing.

Figure 6:
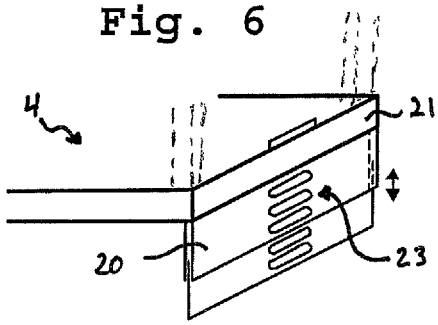

FIG. 6 presents a preferred embodiment of an apron.

Figure 7A:
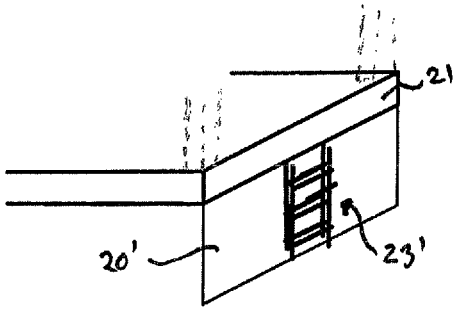

FIG. 7*a* presents a preferred embodiment of an apron.

Figure 7B:
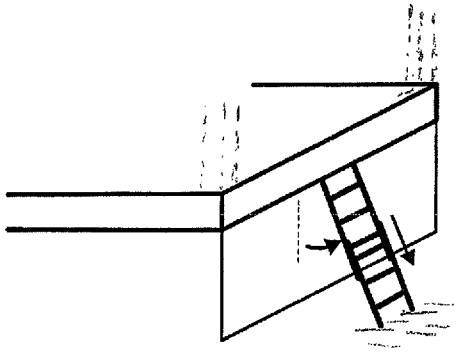

FIG. 7*b* presents a solution according to FIG. 7*a* in the operating position.

DETAILED DESCRIPTION OF THE INVENTION

FIG. 1 presents a phase of the method according to the invention during the manufacture of an elevator, in which phase the displaceable supporting structure 3 for supporting the elevator car 2 below it in the elevator hoistway is in its position in the elevator hoistway 1 and the elevator car 2 is in use to move in the aforementioned elevator hoistway 1 and to transport passengers and/or freight between floors. When the elevator car is in use, elevator hoistway parts e.g. guide rails, are installed above the supporting structure. The supporting structure is supported resting on the support elements 8. When the installation work above the supporting structure has progressed sufficiently, the elevator car 2 is removed from the aforementioned use, the supporting structure is removed from the support of the support elements 8, and a lift is performed, in which the supporting structure 3 above the elevator car 2 is lifted higher up in the elevator hoistway 1, and thus the range of movement of the elevator car 2 is changed to extend farther upwards than before in the elevator hoistway 1. After this the supporting platform 3 is again supported in its place in the hoistway in the position presented by FIG. 2 resting on the support elements 8, after which the elevator car 2 is again taken into use to move in the aforementioned elevator hoistway 1 and to transport passengers and/or freight between floors. The supporting platform 3 can be shifted with a hoist 9 or a crane from the position presented in FIG. 1 higher up in the elevator hoistway to the position presented by FIG. 2, where it can be supported after the lift and the elevator car 2 can again be taken into use. A number of these types of lifts can be performed until the range of movement of the elevator car 2 extends to the desired height in the hoistway, and during the times between consecutive lifts the elevator car is arranged to be taken into the aforementioned type of use.

The supporting structure 3 is a structure displaceable in the vertical direction, which structure at least during use of the elevator car is arranged to support the elevator car below it in the elevator hoistway 1. The supporting structure 3 comprises the aforementioned support elements, more particularly a plurality of support elements 8 movable between a position extended from the supporting structure 3 towards the side and a position retracted towards the supporting structure. In the method, during the lifts to be performed the support elements are in a retracted position, and after the lift the support elements are displaced into the extended position and the frame of the supporting platform is lowered to rest on top of the structures of the building supported by the support elements in the extended position for the vertical support of the supporting platform in the elevator hoistway. The supporting structure also comprises a platform 4, which supports a rope pulley 5 on top of it, supported by which rope pulley the hoisting roping 6 is arranged to hang. The rope pulley 5 is preferably a traction sheave moving and supporting an elevator car by means of hoisting roping, in which case the platform 4 supports the rope pulley 5, which is a traction sheave, and the hoisting machine M to which the traction sheave belongs. From the rope pulley 5 the hoisting roping 6 descends down to the elevator car 2. If the hoisting function will be implemented as one with counterweight, the hoisting roping 6 descends to the elevator car 2 from the first side of the rope pulley 5 and to the counterweight CW from the second side, in the manner presented in FIG. 3.

When disposed thus, the support elements are at a level at the point of which the ropes descending from the rope pulley do not pass. Thus they can be extended in the lateral direction to move more freely. Likewise, the parts of the frame of the supporting structure 3 movably supporting them can be configured to be the desired shape and in the desired point. For example, the support elements 8 that can be moved in opposite lateral directions into an extended position can be connected with a beam 11*a*, as is presented in FIG. 4, which beam 11*a* crosses the elevator hoistway and at the point of the aforementioned rope pulley passes above it. The aforementioned support elements 8 are disposed essentially above the aforementioned rope pulley 5. Preferably the support elements 8 are in connection with the second platform 10 comprised in the supporting structure 3, said second platform being above the aforementioned rope pulley 5.

The aforementioned lift can be performed with some arrangement according to prior art, but preferably it is performed with a lifting device 9, which pulls the supporting platform 3 upwards in the elevator hoistway while resting on a support structure 8 separate to the supporting structure 3, which support structure is supported in the elevator hoistway above the supporting structure 3 at a distance from the supporting structure. The lifting device 9 itself is preferably in connection with the supporting structure 3, as presented in the figure, and preferably accessible from the aforementioned platform 10 of the supporting structure. In the lift, the lifting device 9 preferably pulls the supporting structure 3 upwards via a hoisting rope 7 supported on the aforementioned support structure 8, which hoisting rope travels from the supporting platform to the aforementioned support structure 8, as presented in FIG. 1. The aforementioned second platform 10 preferably has a control unit 30 of the hoisting machine and/or of the hoist 9 of the supporting structure, which control unit is thus simple to access.

After a lift the supporting structure 3 is supported in the elevator hoistway such that its support elements 8 are essentially at the height of a floor landing. More particularly the supporting structure is supported in the elevator hoistway such that its support elements 8 rest on the top surface of the edge of a floor landing and on the top surface of a supporting structure on the opposite side of the elevator hoistway, such as on the top surface of a pocket arranged in the wall of the elevator hoistway. In this case also the second platform 10, the supporting structure of which is above the aforementioned platform 4, is essentially at the height of a floor landing, more particularly such that its standing surface is at most 50 cm above the floor landing. If the building comprises different heights d1 and d2 of floor landings, as presented in FIG. 2, after the aforementioned lift the platform 4 can be at the point of an opening of a floor landing essentially above the floor landing, in which case the aforementioned apron essentially covers, or is arranged to essentially cover, the gap between the edge of the working platform and the sill of the floor landing. The platform 4 is in this case climbed up to from a floor landing along steps and/or the working platform is climbed down from to a floor landing along steps. After the situation presented in FIG. 2, one or more corresponding lifts can still be performed.

FIG. 3 presents in more detail a possible suspension arrangement with which an elevator car can be supported. Configuring the suspension and the lengths of ropes can be implemented in the manner presented in publication WO00/50328A2. If it is desired to implement a solution without counterweight, the suspension can be implemented in the manner presented in publication WO2006/010782A2.

FIG. 4 presents one preferred solution, with which the support elements can be movably supported on the frame of the supporting structure. The figure presents the frame part of a supporting structure 3, on which the support elements 8 are supported such that they can be telescopically displaced with the frame part 11 of the supporting structure between a retracted and an extended position. More precisely, the aforementioned frame of the supporting structure comprises a frame part 11, which is a rigid beam system, which comprises a plurality of beams. The support elements 8 are supported inside hollow beams, telescopically movably horizontally in the longitudinal direction of the beams between an extended and a retracted position. Vertical beams (presented only in FIGS. 1-3) are rigidly connected to the frame part 11, via which vertical beams the frame part 11 is in rigid connection with the platform 4. The frame part 11 forms the supporting structure of the second platform 10. Each platform 4 and 10 is a platform suited for working on top of it, which comprises a flat standing surface. For this purpose there can be a plate or corresponding on top of the frame part 11 of FIG. 4.

The elevator hoistway 1 comprises on one of its sides a plurality of openings O leading onto floor landings. The supporting structure preferably comprises an apron 20,20' that extends downwards, or that can be displaced to extend downwards, from the edge 21 of the platform 4 on the side of the openings leading to a floor landing for covering the gap between the edge 21 of the platform 4 and the sill 22 of the floor landing. The aforementioned apron 20,20' is a flat protrusion extending downwards from the edge 21 or it can be displaced to become a flat protrusion extending downwards from the edge. The aforementioned apron comprises one or more curtains, grilles, plates or nets for covering the gap between the edge of the working platform and the sill of the floor landing. FIG. 5 presents the arrangement according to FIG. 2 as viewed from a floor landing. FIGS. 6-7*b* present some alternative preferred embodiments of the structure of the aforementioned apron. The apron can be fixed or it can displaceable from a retracted state into an extended state, in which extended state the apron extends essentially lower than in the retracted state. The apron is in its width at least essentially the width of the landing opening or even wider than the landing opening. If the apron is not fixed it can displaceable from a retracted state into an extended state telescopically in the manner presented in FIG. 6. Alternatively the apron can be fixed to the supporting structure in a manner allowing bending such that it can be bent to below the supporting structure, preferably essentially in a horizontal position, in which case in can be activated into a vertical position such that moving of the apron from the floor landing by pushing is prevented, or can be prevented, e.g. by locking.

The arrangement can comprise steps 23,23' for ascending from a floor landing to a platform 4/for descending from a platform 4 to a floor landing. The steps are most preferably in the form of a ladder. The steps can be an integral part of the aforementioned apron in the manner presented by FIG. 6, in which case they can be formed with a plurality of holes in the surface of the aforementioned apron facing the platform. Alternatively the steps can be displaceable between an extended usage position and a retracted storage position in the manner presented by FIG. 7*b*. In this case the steps can be fixed to the supporting structure, preferably in a manner that allows bending. Preferably the steps can be displaced into a position resting on the top surface of a floor landing in the manner illustrated in FIG. 7*b*.

The supporting structure can be supported in its position after the lift such that the support elements are essentially at the height of a floor landing. The building can comprise floor-to-floor distances (d1, d2) essentially differing from each other between two consecutive floor landings. In this case the apron 20,20' protects from falling into the hoistway. FIG. 2 presents how a building can, without problem, comprise consecutive floors, the floor-to-floor distance d2 between which is essentially greater than the distance between the support means of the supporting structure 3 and the edge of the working platform and the supporting structure 3 is supported in the elevator hoistway 1 such that its working platform 4 is at the point of the opening O of a floor landing essentially above the floor landing, and the arrangement comprises the aforementioned apron, which covers, or can be arranged at least essentially to cover, the gap between the edge of the supporting structure and the sill of the floor landing.

The elevator to be manufactured with the method and arrangement presented is preferably the final elevator of the building, which elevator is preferably inside the building in the elevator hoistway finally formed for the building. The building is preferably a so-called "high-rise building". As presented in the figures, the solutions can be implemented such that the supporting structure supports an elevator hoisting machine M with a traction sheave, which hoisting machine is arranged, when the elevator is in the aforementioned use, to move the elevator car via the hoisting roping between lifts of the supporting platform, i.e. between jump-lifts, but the hoisting machine could also be elsewhere. In each aforementioned lift the supporting structure is lifted preferably a distance the length of at least one or more floor-to-floor distances. Most preferably the support elements can be displaced into the extended position with a linear movement, but they could be displaceable alternatively by bending. The aforementioned roping can comprise one or more ropes, and a rope can be e.g. round or belt-like in its cross-section.

It is obvious to the person skilled in the art that the invention is not limited to the embodiments described above, in which the invention is described using examples, but that many adaptations and different embodiments of the invention are possible within the frameworks of the inventive concept defined by the claims presented below.

The invention claimed is:

1. A method in the manufacture of an elevator, which elevator comprises, during a construction-time, an elevator hoistway, an elevator car, hoisting roping for supporting and moving the elevator car during use of the elevator car, a supporting structure movable in a vertical direction for supporting the elevator car below it in the elevator hoistway, which supporting structure comprises:

a plurality of support elements movable between a position extended, from the supporting structure towards a side of the elevator hoistway, and a position retracted, towards the supporting structure, and a platform, which supports a rope pulley, supported by which the hoisting roping is arranged to hang, in which method plurality of lifts are performed, in each of which lifts the supporting structure is lifted higher up in the elevator hoistway, while the plurality of support elements is in the retracted position, after which the plurality of support elements is displaced into the extended position and the supporting structure is lowered to rest on top of the structures of the building, whereby the supporting structure is supported by the plurality of support elements in the extended position for a vertical support of the supporting structure in the elevator hoistway, in which method, between lifts, the elevator car is used for transporting passengers and/or freight between floors, wherein the plurality of support elements is above the rope pulley and hoisting roping.

2. The method according to claim 1, wherein the elevator hoistway comprises on one of its sides a plurality of openings leading onto floor landings, and the supporting structure comprises an apron that extends downwards, or that can be displaced to extend downwards, from an edge of the platform on a side of the platform opposite the openings and leading to one of the floor landings for covering a gap between the edge of the platform and a sill of said one of the floor landings.

3. The method according to claim 2, wherein in the method a lift is performed, after which the supporting structure is supported in the elevator hoistway such that its platform is at a point of an opening of another floor landing above said one of the floor landings, the apron essentially covers, or is arranged to essentially cover, a gap between an edge of the platform and a sill of said another floor landing.

4. The method according to claim 2, wherein the supporting structure comprises a second platform above the platform, and that in the method a lift is performed, after which the supporting structure is supported in the elevator hoistway such that the second platform is essentially at a height of another floor landing.

5. The method according to claim 1, wherein the supporting structure comprises a second platform above said platform, and that in the method a lift is performed, after which the supporting structure is supported in the elevator hoistway such that the second platform is essentially at a height of a floor landing.

6. The method according to claim 1, wherein the platform is climbed up to from a floor landing along steps and/or the platform is climbed down to the floor landing along steps.

7. The method according to claim 1, wherein in the method a lift is performed, after which the supporting structure is supported in the elevator hoistway such that the plurality of support elements is essentially at a height of a floor landing.

8. The method according to claim 1, wherein in the method a lift is performed, after which the supporting structure is supported in the elevator hoistway such that the plurality of support elements of said supporting structure rest on a top surface of an edge of a floor landing and on a top surface of a supporting structure on a side of the elevator hoistway opposite the floor landing.

9. The method according to claim 1, wherein the rope pulley is a traction sheave of a hoisting machine.

10. The method according to claim 1, wherein the supporting structure comprises a second platform above the rope pulley, in connection with which second platform the support elements are provided.

11. The method according to claim 1, wherein the platform and/or the second platform comprises a flat standing surface.

12. The method according to claim 1, wherein the plurality of support elements can be telescopically displaced relative to a frame part of the supporting structure between a retracted and an extended position.

13. The method according to claim 1, wherein the plurality of support elements can be displaced in a horizontal direction, with a linear movement, between a retracted and an extended position.

14. The method according to claim 1, wherein the plurality of support elements comprises support elements that can be displaced in opposite lateral directions into an extended position.

15. The method according to claim 1, wherein the plurality of support elements are supported on a frame part of the supporting structure, said frame part being above the rope pulley, which frame part is a beam structure, which at least partly forms the second platform.

16. The method according to claim 1, wherein the arrangement comprises steps for ascending/decending from/to a floor landing to/from the platform descending.

17. The method according to claim 1, wherein the supporting structure is supported in the elevator hoistway such that its platform is at a point of the opening of a floor landing essentially above the floor landing, and in that the arrangement comprises an apron, which covers, or can be arranged to at least essentially cover, a gap between an edge of the platform and a sill of the floor landing.

18. An elevator arrangement during construction of the elevator, which elevator arrangement comprises:

an elevator hoistway, an elevator car, hoisting roping for supporting and moving the elevator car during use of the elevator car, a supporting structure movable in a vertical direction for supporting the elevator car below it in the elevator hoistway via hoisting roping, which supporting structure comprises:

a plurality of support elements movably supported on the supporting structure and movable between a position extended, from the supporting structure towards a side of the elevator hoistway, and a position retracted, towards the supporting structure, supported by which plurality of support elements in the extended position the supporting structure can be lowered to rest on top of structures of a building for a vertical support of the supporting structure in the elevator hoistway, and when in the retracted position of which plurality of support elements the supporting structure can be displaced in the vertical direction in the elevator hoistway without being obstructed by the plurality of support elements; and a platform, which supports a rope pulley, supported by which the hoisting roping is arranged to hang, wherein the plurality of support elements is above the rope pulley and the hoisting roping.

19. The arrangement according to claim 18, wherein the elevator hoistway comprises on one of its sides a plurality of openings leading onto floor landings, and the supporting structure comprises an apron that extends downwards, or that can be displaced to extend downwards, from an edge of the platform on a side of platform opposite the plurality of openings and leading to one of the floor landings for covering a gap between the edge of the platform and a sill of said one of the floor landings.

* * * * *